US008356410B2

(12) United States Patent
Zhao et al.

(10) Patent No.: US 8,356,410 B2
(45) Date of Patent: Jan. 22, 2013

(54) HEAT PIPE DISSIPATING SYSTEM AND METHOD

(75) Inventors: Yuan Zhao, Thousand Oaks, CA (US); Chunglung Chen, Thousand Oaks, CA (US)

(73) Assignee: The Boeing Company, Chicago, IL (US)

( * ) Notice: Subject to any disclaimer, the term of this patent is extended or adjusted under 35 U.S.C. 154(b) by 1142 days.

(21) Appl. No.: 11/762,422

(22) Filed: Jun. 13, 2007

(65) Prior Publication Data

US 2008/0307651 A1 Dec. 18, 2008

(51) Int. Cl.
*B21D 53/02* (2006.01)
*F28D 15/02* (2006.01)
*F28D 15/04* (2006.01)

(52) U.S. Cl. ..... 29/890.032; 29/890.045; 165/104.26

(58) Field of Classification Search ..... 29/890.032, 29/890.045; 165/104.21, 104.26, 104.33; 257/E23.088, 715
See application file for complete search history.

(56) References Cited

U.S. PATENT DOCUMENTS 3,598,180 A 8/1971 Moore, Jr.
3,613,778 A 10/1971 Feldman, Jr.
5,598,632 A * 2/1997 Camarda et al. ..... 29/890.032
5,642,776 A 7/1997 Meyer, IV
6,158,502 A 12/2000 Thomas
6,639,799 B2 10/2003 Prasher et al.
6,760,222 B1 7/2004 Wang
6,880,626 B2 4/2005 Lindemuth et al.
6,935,022 B2 * 8/2005 German et al. ..... 29/890.032
6,945,317 B2 9/2005 Garner et al.
7,027,304 B2 * 4/2006 Aisenbrey ..... 361/704
7,392,836 B2 * 7/2008 Wong ..... 165/104.26
2002/0139516 A1 * 10/2002 Zuo ..... 165/104.26
2002/0179284 A1 12/2002 Joshi
2003/0136551 A1 * 7/2003 Bakke ..... 165/104.26
2006/0219391 A1 * 10/2006 Hong et al. ..... 165/104.26
2007/0017814 A1 1/2007 Hwang et al.
2007/0062682 A1 * 3/2007 Sagi et al. ..... 165/173

OTHER PUBLICATIONS

The Boeing Company, International Application No. PCT/US2008/063942, Search Report dated Sep. 9, 2008.

* cited by examiner

*Primary Examiner* — Alexander P Taousakis
(74) *Attorney, Agent, or Firm* — Klintworth & Rozenblat IP LLC

(57) ABSTRACT

In one embodiment of the disclosure, a heat pipe device for dissipating heat from a heat source includes a porous wick structure having a first porous wick portion disposed adjacent to a second porous wick portion. The first porous wick portion is defined by a first set of microgrooves. The second porous wick portion is defined by a second set of microgrooves disposed in non-parallel adjacent alignment to the first set of microgrooves. The heat pipe device may be disposed within a closed chamber enclosure to which the heat source is attached. In further embodiments, methods are disclosed for manufacturing devices for dissipating heat from a heat source, and for using devices to dissipate heat from a heat source.

18 Claims, 5 Drawing Sheets

HEAT PIPE DISSIPATING SYSTEM AND METHOD

BACKGROUND

Many heat pipe devices and methods exist for dissipating heat from a heat source. For instance, in one existing heat pipe device, a closed chamber is used. The closed chamber has a porous wick layer extending around a perimeter of the inner surface of the chamber. In the center of the chamber is an empty cavity. The chamber is filled with a saturated working fluid with liquid only existing in the voids of the wick. When heat is applied in an evaporator area, the liquid in the evaporator wick vaporizes and fills the center cavity. Since the opposite side of the evaporator is cooled, the vapor condenses on that side. The condensed liquid is wicked back to the evaporator by capillary force. However, this type of structure or process, or other types of existing structures or processes, may experience one or more problems in practical applications, especially for high power density electronics. The problems may include insufficient structure strength, low capacity, low tolerance to local heat fluxes at hot spots, poor performance at high heat flux conditions, complex internal constructions, high manufacturing costs, and/or one or more other types of problems.

A device, method of use, and/or method of manufacture is needed to decrease one or more problems associated with one or more of the existing devices and/or methods for dissipating heat from a heat source.

SUMMARY

In one aspect of the disclosure, a device is provided for dissipating heat from a heat source. The device comprises a porous wick structure comprising a first porous wick portion disposed adjacent to a second porous wick portion. The first porous wick portion is defined by a first set of microgrooves. The second porous wick portion is defined by a second set of microgrooves disposed in non-parallel adjacent alignment to the first set of microgrooves.

In another aspect of the disclosure, a method of dissipating heat from a heat source is disclosed. In one step, a porous wick structure is provided having a first porous wick portion disposed adjacent to a second porous wick portion. The first porous wick portion is defined by a first set of microgrooves disposed in non-parallel adjacent alignment to a second set of microgrooves defined in the second porous wick portion. In another step, a surface of the porous wick structure is disposed at least one of against and near a heat source. In still another step, saturated fluid is charged within first porous walls of the first set of microgrooves and second porous walls of the second set of microgrooves. In yet another step, some of the fluid is evaporated near the surface of the porous wick structure to form a vapor and dissipate heat from the heat source. In an additional step, vapor is flowed between and within the adjacent second and first sets of microgrooves. In another step, the vapor is condensed into a liquid away from the surface of the porous wick structure. In still another step, the condensed liquid is flowed to at least one of the first and second porous walls.

In a further aspect of the disclosure, a method is disclosed of manufacturing a device for dissipating heat from a heat source. In one step, a first porous wick portion is molded so that it is defined by a first set of microgrooves. In another step, a second porous wick portion is molded so that it is defined by a second set of microgrooves. In still another step, the first porous wick portion is disposed adjacent to the second porous wick portion so that the first set of microgrooves is disposed in non-parallel adjacent alignment to the second set of microgrooves. In an additional step, the first and second porous wick portions are sintered together.

In still another aspect of the disclosure, a vapor chamber is provided for transferring heat with an internal working fluid. The vapor chamber comprises a sealed enclosure having interior walls which contain a wick material attached to at least one of the walls. The wick material includes a first portion oriented in a first direction and a second portion oriented in a second direction different than the first direction. The working fluid is free to travel in both the first and second directions.

These and other features, aspects and advantages of the disclosure will become better understood with reference to the following drawings, description and claims.

DETAILED DESCRIPTION

The following detailed description is of the best currently contemplated modes of carrying out the disclosure. The description is not to be taken in a limiting sense, but is made merely for the purpose of illustrating the general principles of the disclosure, since the scope of the disclosure is best defined by the appended claims.

Figure 1:
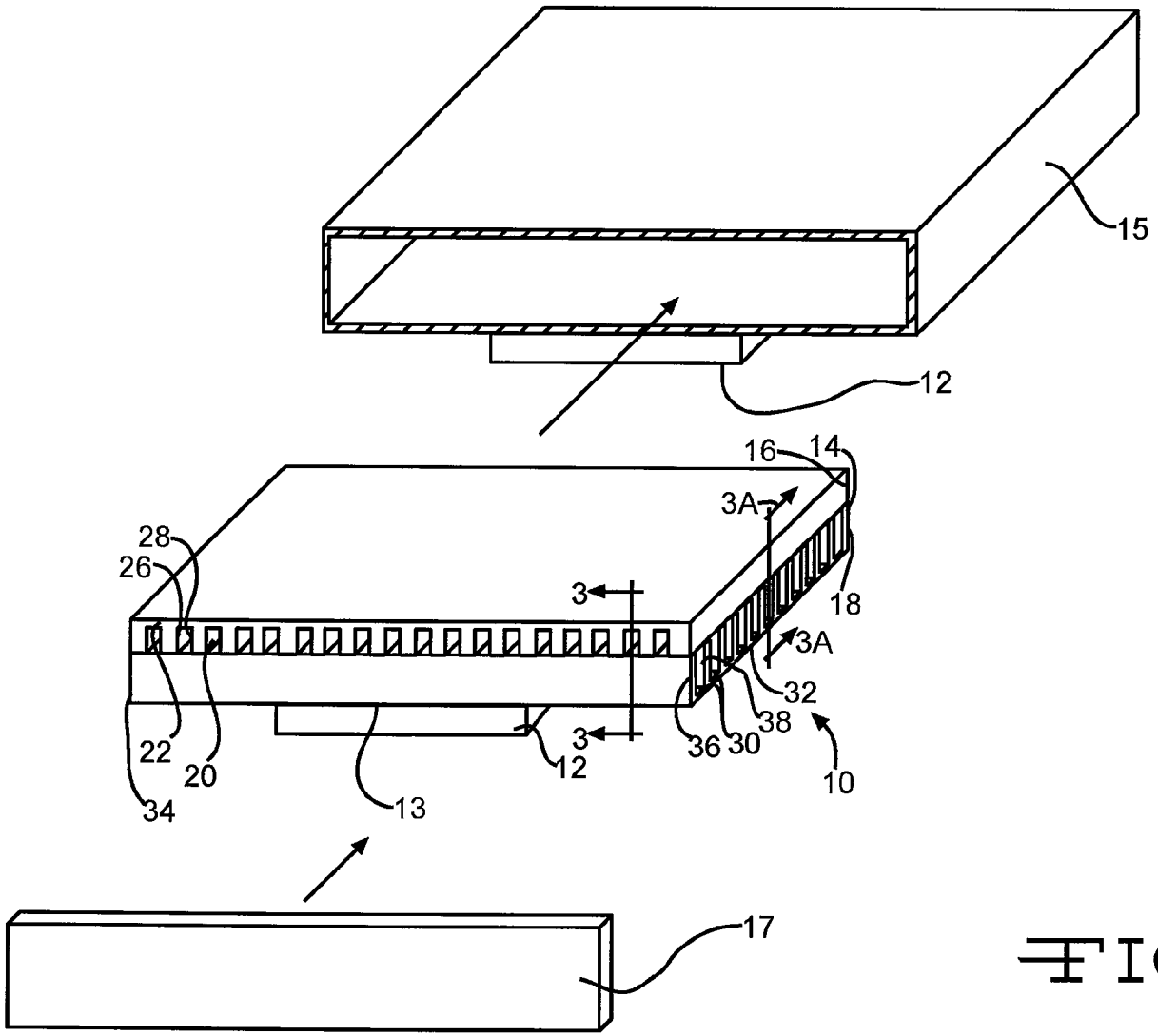
FIG. 1 shows a perspective view of one embodiment of a device for dissipating heat from an attached heat source.

FIG. 1 shows a perspective view of one embodiment of a heat pipe device 10 for dissipating heat from a heat source 12 to which a surface 13 of the heat pipe device 10 may be aligned near or attached. The device 10 may be adapted to be enclosed within a chamber enclosure 15 having a cover 17 which is adapted to seal the device 10 within the closed chamber enclosure 15. The chamber enclosure 15 may be adapted to be aligned near or attached to the heat source 12 to heat up the surface 13 of the device 10 disposed within the chamber enclosure 15. In other embodiments, any type of chamber enclosure 15 may be utilized, and the heat source 12 may be applied along any portion of the chamber enclosure 15 to heat up any surface of the device 10. Although some of the figures of the instant disclosure show the heat source 12 abutting directly against the device 10 without showing the intermediate chamber enclosure 15, for any of the embodiments disclosed herein, the intermediate chamber enclosure 15 may be disposed in between the heat source 12 and the device 10. The heat source 12 may comprise any type of heat source needing heat dissipation such as a laser diode array, a motor controller, an electronic device, a heat sink, a missile device, a communication device, an aeronautical device, or other type of heat source. The device 10 may comprise a porous wick structure 14 comprising a first porous wick portion 16 disposed adjacent to, and attached to, a second porous wick portion 18. Each of the first and second porous wick portions 16 and 18 may comprise separately molded members which are attached to one another through a sintering process, or through another type of attachment process.

Figure 2:
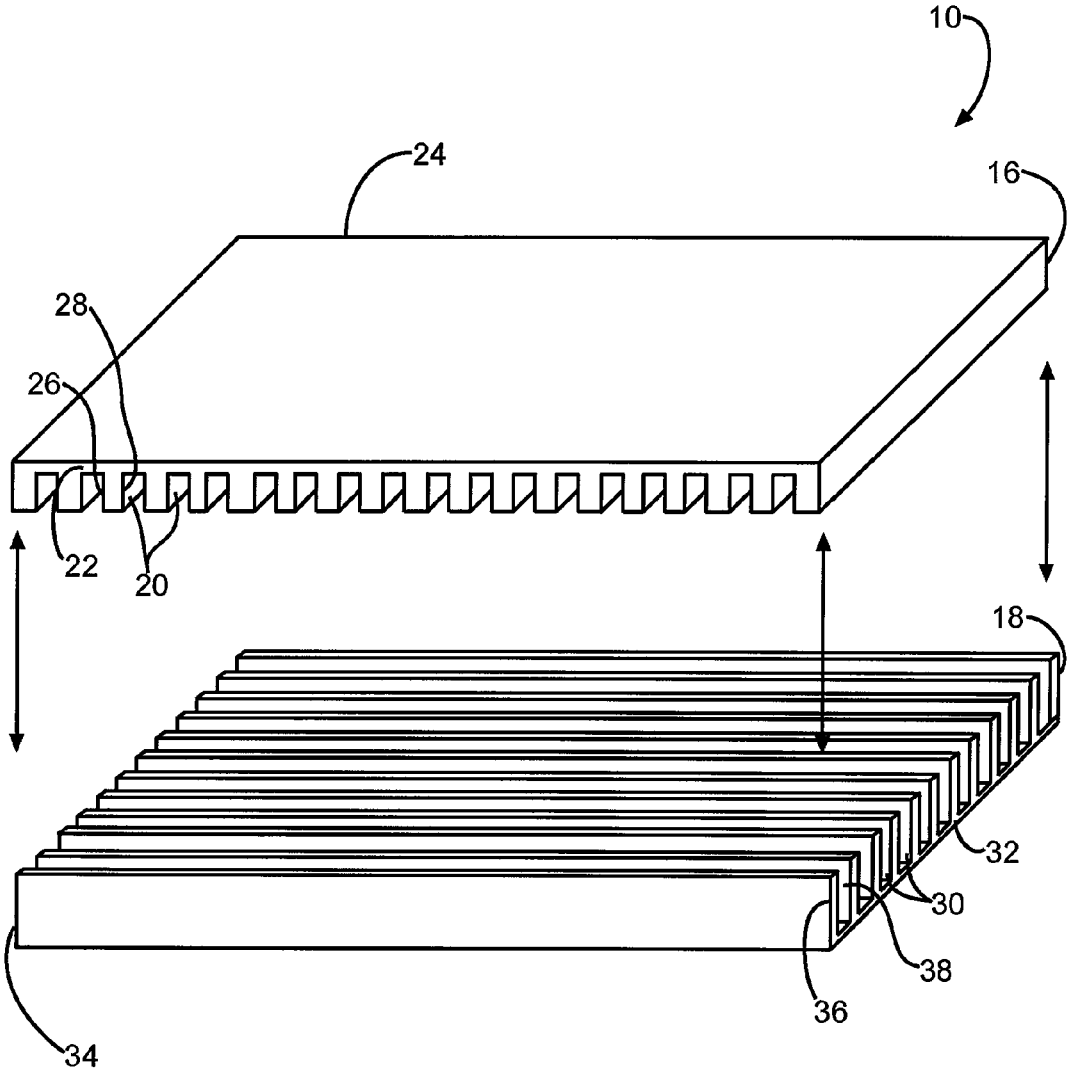
FIG. 2 shows a partially unassembled, perspective view of the device of FIG. 1, with a first porous wick portion separated from a second porous wick portion.

FIG. 2 shows a partially unassembled, perspective view of the device 10 of FIG. 1, with the first porous wick portion 16 separated from the second porous wick portion 18. As shown in FIGS. 1 and 2, the first porous wick portion 16 may be defined by a first set of microgrooves 20 which may extend in a parallel configuration from one end 22 to another end 24 of the first porous wick portion 16. Each of the first set of microgrooves 20 may be defined by opposing side first porous walls 26 and 28. In other embodiments, the first porous wick portion 16 may have a first set of microgrooves 20 which are of varying sizes, orientations, and/or configurations.

Similarly, the second porous wick portion 18 may be defined by a second set of microgrooves 30 which may extend in a parallel configuration from one end 32 to another end 34 of the second porous wick portion 18. Each of the microgrooves 30 may be defined by opposing side second porous walls 36 and 38. As shown, the second set of microgrooves 30 may be of the same size as the first set of microgrooves 20. In other embodiments, the second porous wick portion 18 may have a second set of microgrooves 30 which are of varying sizes, orientations, and/or configurations.

As shown in FIG. 1, when the first porous wick portion 16 is attached to the second porous wick portion 18, the first set of microgrooves 20 may be disposed in a substantially perpendicular, adjacent alignment to the second set of microgrooves 30. In other embodiments, the first set of microgrooves 20 may be disposed in alternative orientations and configurations with respect to the second set of microgrooves 30, such as in any type of non-parallel, adjacent alignment.

Figure 3:
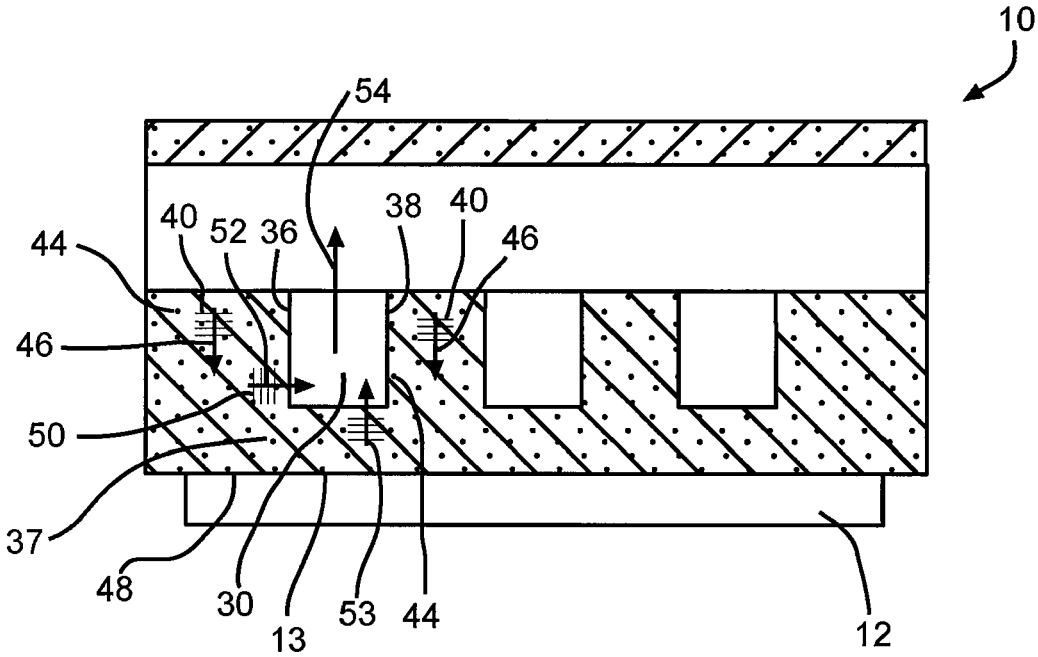
FIGS. 3 and 3A show cross-sections of the device of FIG. 1 through lines 3-3 and lines 3A-3A respectively.
Figure 3A:
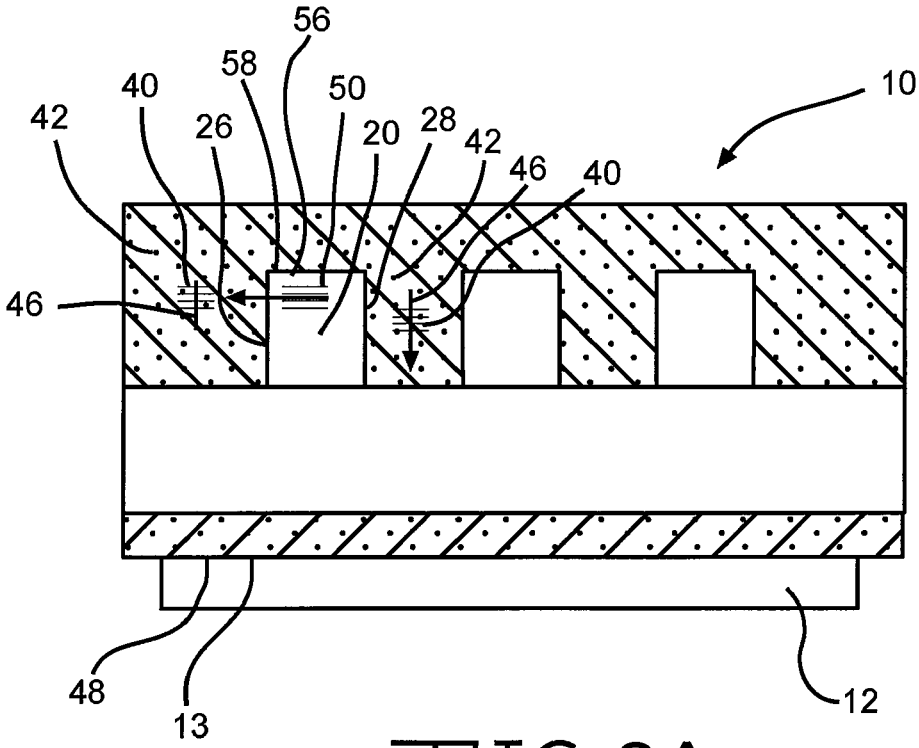

FIGS. 3 and 3A show cross-sections of the device 10 of FIG. 1 through lines 3-3 and lines 3A-3A respectively. As shown in FIGS. 1-3A, the first porous walls 26 and 28 of each of the first set of microgrooves 20 may be interconnected to the second porous walls 36 and 38 of each of the second set of microgrooves 30. In such manner, as shown in FIG. 3-3A, saturated liquid 40 may flow within the pores 42 of each of the first porous walls 26 and 28 through, between, and within the pores 44 of each of the second porous walls 36 and 38 as shown by representative direction 46. In other embodiments, the fluid 40 may flow in any direction within and between the pores 42 and 44 of each of the first and second porous walls 26, 28, 36, and 38.

When heat is applied at hop spot 48 at or near the surface 13 of the device 10 which is attached to a hear source 12, the saturated liquid 40 residing within the porous sub-layer 37 and second porous walls 36 and 38 may evaporate at vapor/liquid interfaces within sub-layer 37 and second porous walls 36 and 38, or may boil near the hot spot 48 and form a vapor 50. The vapor 50 may flow through the pores 44 of the porous sub-layer 37 if boiling takes place and may subsequently enter the second set of microgrooves 30 as shown by representative directions 52 and 53. In other embodiments, the vapor 50 may flow in any direction out of the pores 42 and 44 of each of the first and second porous walls 26, 28, 36, and 38. The vapor 50 may flow within and between the second set of microgrooves 30 and the interconnected first set of microgrooves 20 in representative direction 54. In other embodiments, the vapor 50 may flow in any direction within and between the first and second sets of microgrooves 20 and 30.

When the vapor 50 is far enough away from the hot spot 48, for instance at representative area 56 within the first set of microgrooves 20, the vapor 50 may condense into a fluid 58. In other embodiments, the vapor 50 may condense back into a liquid at any contact surface within the first and second set of microgrooves 20 and 30 that is colder than the hot spot 48. The capillary forces generated by the pores 42 and 44 may return the condensed liquid 58 from the colder area 56, through the pores 42, and 44, and back to the hot spot area 48.

The condensed fluid 58 may then re-circulate through, between, and within the pores 42 and 44 of the first and second porous walls 26, 28, 36, and 38, in order to repeat the process and continue to cool hot spots 48. In other embodiments, the condensed fluid 58 may re-circulate through, between, and within the pores 42 and 44 of the first and second porous walls 26, 28, 36, and 38 in any direction in order to cool hot spots 48.

In another embodiment, a vapor chamber 15 may be provided for transferring heat with an internal working fluid 40. The vapor chamber 15 may comprise a sealed enclosure having interior walls and containing a porous wick material 14 attached to at least one interior wall of the vapor chamber 15. The porous wick material 14 may include a first portion 16 oriented in a first direction, and a second portion 18 oriented in a second direction different than the first direction. The first and second portions 16 and 18 may be interlocked to provide a stronger structure to withstand the internal to external pressure differential. As a result, the vapor chamber 15 may be sturdier, may be made more lightweight by thinner walls, and/or may avoid the need for additional supporting structures.

Each of the respective first and second portions 16 and 18 may have respective microgrooves 20 and 30 which define the direction of orientation. The microgrooves 20 and 30 may be regular in size and straight, or in other embodiments may be irregular and curvy. In one embodiment, the first and second directions of the first and second portions 16 and 18 may be substantially perpendicular. In other embodiments, the first and second directions may be in varying orientations and configurations relative to one another. In still other embodiments, more than two portions may be used with more than two directions to provide increased heat transfer in a plurality of directions. The fluid 40 may be free to travel within the porous wick material 14 in both of the first and second directions. In such manner, by providing fluid travel in two or more directions, the heat transfer effectiveness may be improved. Vapor 50 may more readily escape from heated spots 13 through the sets of microgrooves 20 and 30.

Figure 4:
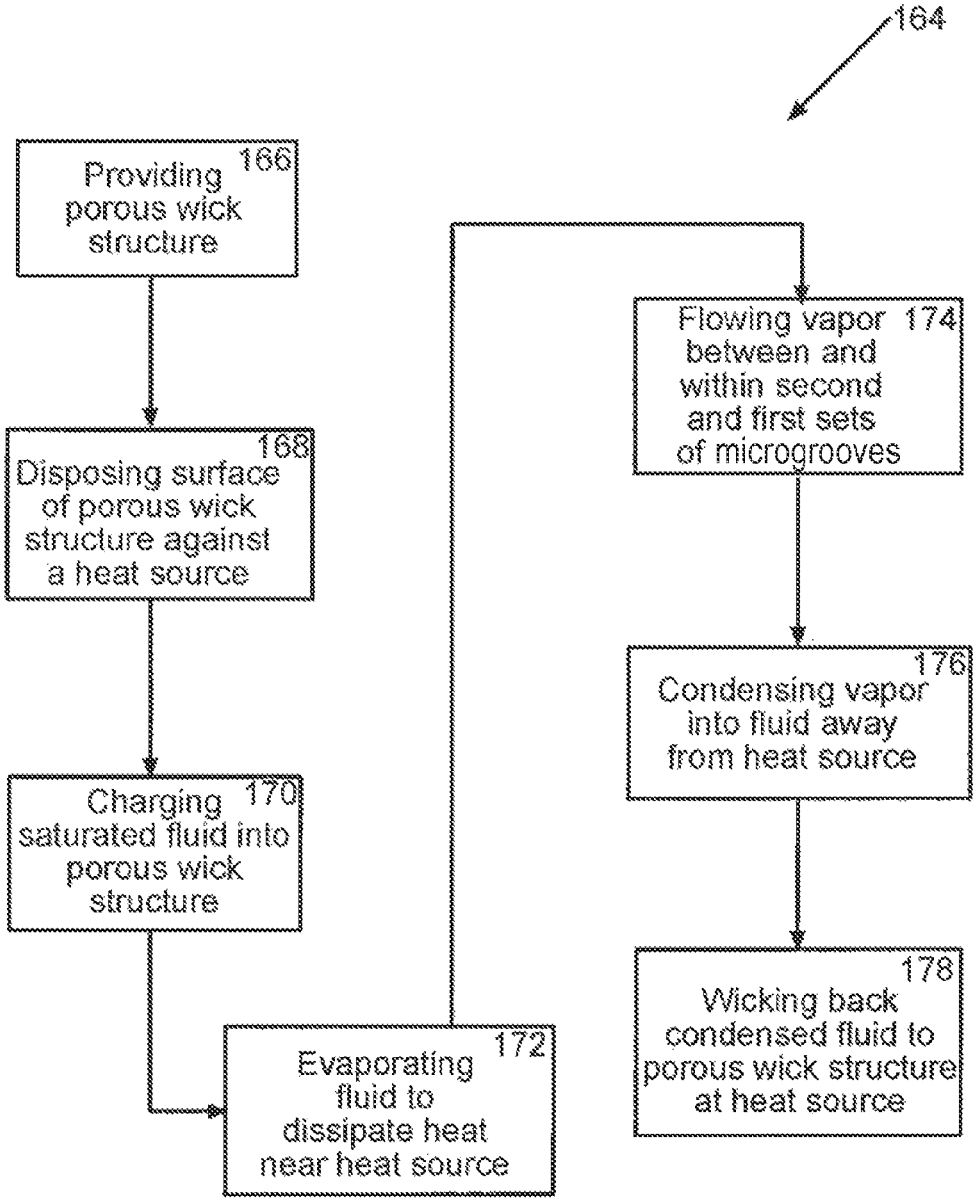
FIG. 4 is a flowchart showing one embodiment of a method of dissipating heat from a heat source.

FIG. 4 shows a flow chart of one embodiment 164 of a method of dissipating heat from a heat source 12. In step 166, a porous wick structure 14 may be provided having a first porous wick portion 16 disposed adjacent to a second porous wick portion 18. Each of the first and second porous wick portions 16 and 18 may comprise separately molded members which are attached to one another through a sintering process, or through another type of attachment process. The first porous wick portion 16 may be defined by a first set of microgrooves 20 disposed in non-parallel, adjacent alignment to a second set of microgrooves 30 defined in the second porous wick portion 18.

In one embodiment, the first and second sets of microgrooves 20 and 30 may be disposed in substantially perpendicular adjacent alignment. The first and second sets of microgrooves 20 and 30 may be interconnected so that a vapor 50 may flow between the first and second sets of microgrooves 20 and 30. The first porous walls 26 and 28 of the first set of microgrooves 20 may be interconnected to the second porous walls 36 and 38 of the second set of microgrooves 30 so that a fluid 40 may flow between and within the first and second porous walls 26, 28, 36, and 38.

In step 168, a surface 13 of the porous wick structure 14 may be disposed against a heat source 12. In step 170, a proper amount of saturated working fluid may be charged into the closed chamber with liquid phase 40 residing only within the first porous walls 26 and 28 of the first set of microgrooves 20 and the second porous walls 36 and 38 of the second set of microgrooves 30. In step 172, some of the liquid 40 may evaporate at or near the surface 13 of the porous wick structure 14 to dissipate heat from the heat source 12 and form a vapor 50. In step 174, the vapor 50 may flow between and within the adjacent second and first sets of microgrooves 30 and 20. In step 176, the vapor 50 may be condensed into a condensed fluid 58 at a contact surface 56 that is colder than the surface 13. In step 178, the condensed fluid 58 may flow into the first porous walls 26 and 28, the second porous walls 36 and 38, and/or the porous sub-layer 37.

Figure 5:
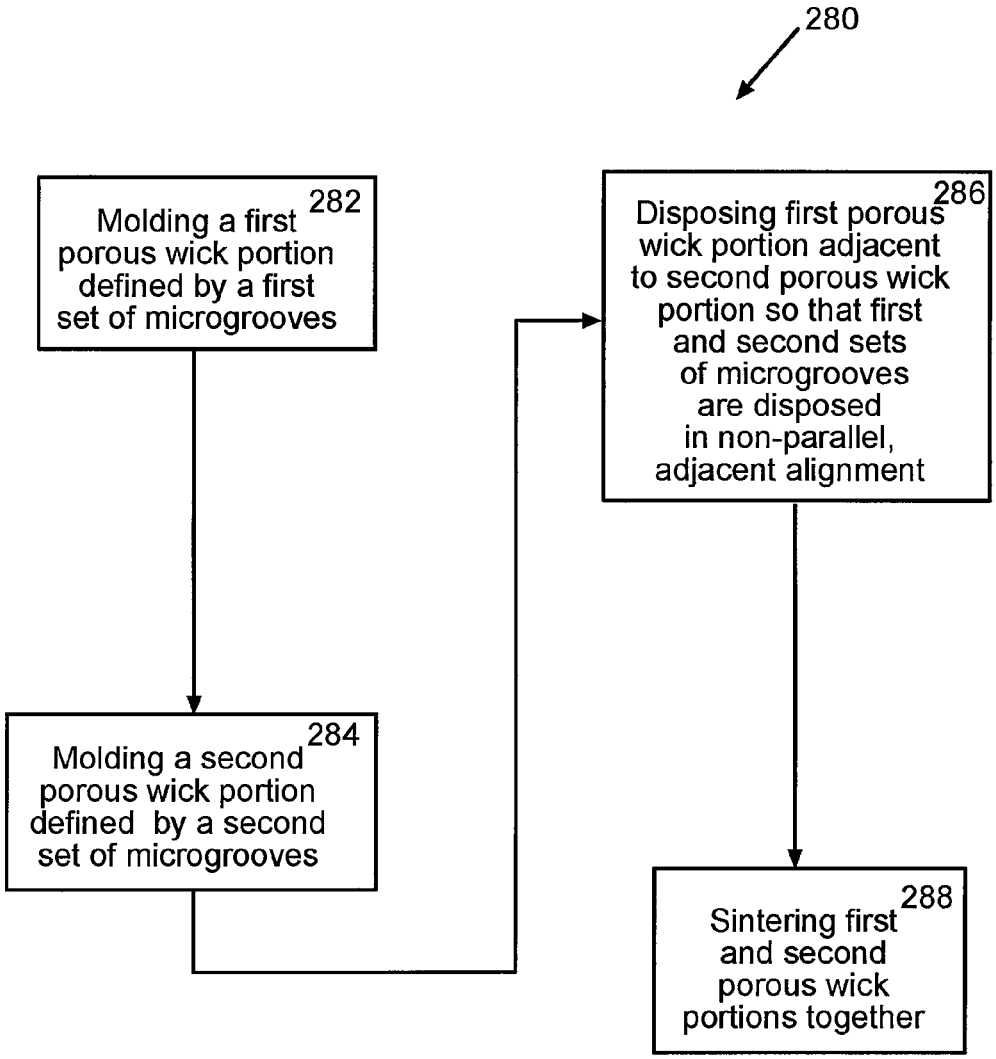
FIG. 5 is a flowchart showing one embodiment of a method for manufacturing the wick structures for a heat pipe device for dissipating heat from a heat source.

FIG. 5 shows a flow chart of an embodiment 280 of a method of manufacturing a device 10 for dissipating heat from a heat source 12. In step 282, a first porous wick portion 16 may be molded so that it is defined by a first set of microgrooves 20. In step 284, a second porous wick portion 18 may be molded so that it is defined by a second set of microgrooves 30. Both of the first and second porous wick portions 16 and 18 may be molded using at least one of a copper powders and a viscous binder. In other embodiments, other types of materials may be used. After drying the first and second molded porous wick portions 16 and 18, each of the first and second porous wick portions 16 and 18 may be separately heated in an oven and separately sintered at substantially 850 degrees Celsius. In other embodiments, varying processes and temperatures may be used.

In step 286, the first porous wick portion 16 may be disposed adjacent to the second porous wick portion 18 so that the first set of microgrooves 20 is disposed in non-parallel, adjacent alignment to the second set of microgrooves 30. In step 288, the first and second porous wick portions 16 and 18, including the first and second sets of microgrooves 20 and 30, may be sintered together. In one embodiment, the sintering may occur at substantially 950-1,000 degrees Celsius. In other embodiments, the sintering may occur at varying temperatures.

After the first and second wick portions 20 and 30 are sintered together, they may be fixedly disposed in a non-parallel, adjacent alignment, such as in a perpendicular, adjacent alignment. At this time, the first and second sets of microgrooves 20 and 30 may be fixedly disposed so that they are interconnected to allow vapor 50 to flow within and between the first and second sets of microgrooves 20 and 30. Similarly, at this time, the first porous walls 26 and 28 of the first set of microgrooves 20, and the second porous walls 36 and 38 of the second set of microgrooves 30 may be fixedly disposed so that they are interconnected to allow fluid 40 to flow within and between the first and second porous walls 26, 28, 36, and 38. The first and second wick portions 20 and 30 may be inserted within a closed chamber enclosure 15.

One or more embodiments of the disclosure may provide one or more of the following advantages over one or more of the existing devices and/or methods: increased capillary limits; increased heat flux; increased structure strength; decreased size or weight; decreased complexity; decreased manufacturing costs; increased efficiency; increased cooling; and/or one or more other types of advantages over one or more of the existing devices and/or methods.

It should be understood, of course, that the foregoing relates to exemplary embodiments of the disclosure and that modifications may be made without departing from the spirit and scope of the disclosure as set forth in the following claims.

The invention claimed is:

1. A method of manufacturing a device for dissipating heat from a heat source, the method comprising:

molding a first porous wick portion having a first set of microgrooves;

molding a second porous wick portion having a second set of microgrooves;

separately sintering each of the molded first and second porous wick portions, disposing the sintered first porous wick portion adjacent to the sintered second wick portion so that the first set of microgrooves is disposed in non-parallel adjacent alignment to the second set of microgrooves; and sintering the first and second adjacent porous wick portions together.

2. The method of claim 1 wherein the first and second porous wick portions are molded using at least one of copper powders or a viscous binder.

3. The method of claim 1 wherein each of the molded first and second porous wick portions are each separately sintered at substantially 850 degrees Celsius.

4. The method of claim 1 wherein the first and second porous wick portions are sintered together at substantially 950-1,000 degrees Celsius.

5. The method of claim 1 wherein, when the first and second wick portions are sintered together, the first and second sets of microgrooves are disposed in a perpendicular and adjacent alignment.

6. The method of claim 1 further comprising disposing the first and second porous wick portions within a closed chamber enclosure.

7. The method of claim 1 wherein the sintering the first and second adjacent porous wick portions together comprises interconnecting said first and second sets of microgrooves so that they are configured to allow vapor to flow between and within said first and second set of microgrooves.

8. The method of claim 1 wherein the sintering the first and second adjacent porous wick portions together comprises interconnecting first porous walls of said first set of microgrooves and second porous walls of said second set of microgrooves so that they are configured to allow fluid to flow between and within said first and second porous walls.

9. The method of claim 1 further comprising, after sintering the first and second adjacent porous wick portions together, charging saturated fluid within first porous walls of said first set of microgrooves and second porous walls of said second set of microgrooves.

10. The method of claim 9 further comprising disposing a surface of the sintered together first and second porous wick portions against or adjacent to a heat source.

11. The method of claim 10 wherein the heat source comprises at least one of a laser diode array, a motor controller, an electronic device, a heat sink, a missile device, a communication device, or an aeronautical device.

12. A method of manufacturing a device for dissipating heat from a heat source, the method comprising:

molding a first porous wick portion having a first set of microgrooves;

molding a second porous wick portion having a second set of microgrooves;

separately sintering each of the molded first and second porous wick portions, disposing the sintered first porous wick portion adjacent to the sintered second wick portion so that the first set of microgrooves is disposed in a substantially perpendicular adjacent alignment to the second set of microgrooves; and sintering the first and second adjacent porous wick portions together.

13. The method of claim 12 wherein the first and second porous wick portions are molded using at least one of copper powders or a viscous binder.

14. The method of claim 12 wherein each of the molded first and second porous wick portions are each separately sintered at substantially 850 degrees Celsius.

15. The method of claim 12 wherein the first and second porous wick portions are sintered together at substantially 950-1,000 degrees Celsius.

16. The method of claim 12 further comprising disposing the first and second porous wick portions within a closed chamber enclosure.

17. The method of claim 12 wherein the sintering the first and second adjacent porous wick portions together comprises interconnecting said first and second sets of microgrooves so that they are configured to allow vapor to flow between and within said first and second set of microgrooves.

18. The method of claim 12 wherein the sintering the first and second adjacent porous wick portions together comprises interconnecting first porous walls of said first set of microgrooves and second porous walls of said second set of microgrooves so that they are configured to allow fluid to flow between and within said first and second porous walls.

* * * * *